United States Patent [19]

Young

[11] 4,353,652

[45] Oct. 12, 1982

[54] APPARATUS FOR GRAVITY BLENDING OR PARTICULATE SOLIDS

[76] Inventor: Henry T. Young, 801 Merrill Pl., North Myrtle Beach, S.C. 29582

[21] Appl. No.: 140,700

[22] Filed: Apr. 16, 1980

[51] Int. Cl.[3] ..... B01F 5/24

[52] U.S. Cl. ..... 366/193; 366/341

[58] Field of Search ..... 366/9, 341, 136, 137, 366/189, 192, 193, 134, 163, 191; 414/268

[56] References Cited

U.S. PATENT DOCUMENTS

| | | | |
|---|---|---|---|
| 3,138,369 | 6/1964 | Bennett et al. | 366/136 |
| 3,158,362 | 11/1964 | Seifarth | 366/134 |
| 3,317,191 | 5/1967 | Brown et al. | 366/136 |
| 3,361,413 | 1/1968 | Heyl | 366/137 |
| 3,532,328 | 10/1970 | Avril | 366/9 |

*Primary Examiner*—Philip R. Coe

*Attorney, Agent, or Firm*—Ward, Lalos, Leeds, Keegan & Lett

[57] ABSTRACT

A method and apparatus for blending a mass of heterogeneous material including a first storage vessel having a material receiving port, a multiplicity of particulate solids withdrawal downcomers having inlet ports at the upper ends communicating at preselected vertically and circumferentially spaced apart locations with the first storage vessel and having outlet ports at the lower ends thereof communication with a second storage vessel having a material exiting port at a lower end thereof, and a multiplicity of particulate solids withdrawal downcomers having inlet ports at the upper ends communicating at preselected vertically and circumferentially spaced apart locations with the second storage vessel and having outlet ports at the lower ends thereof communicating with the material exiting port.

12 Claims, 9 Drawing Figures

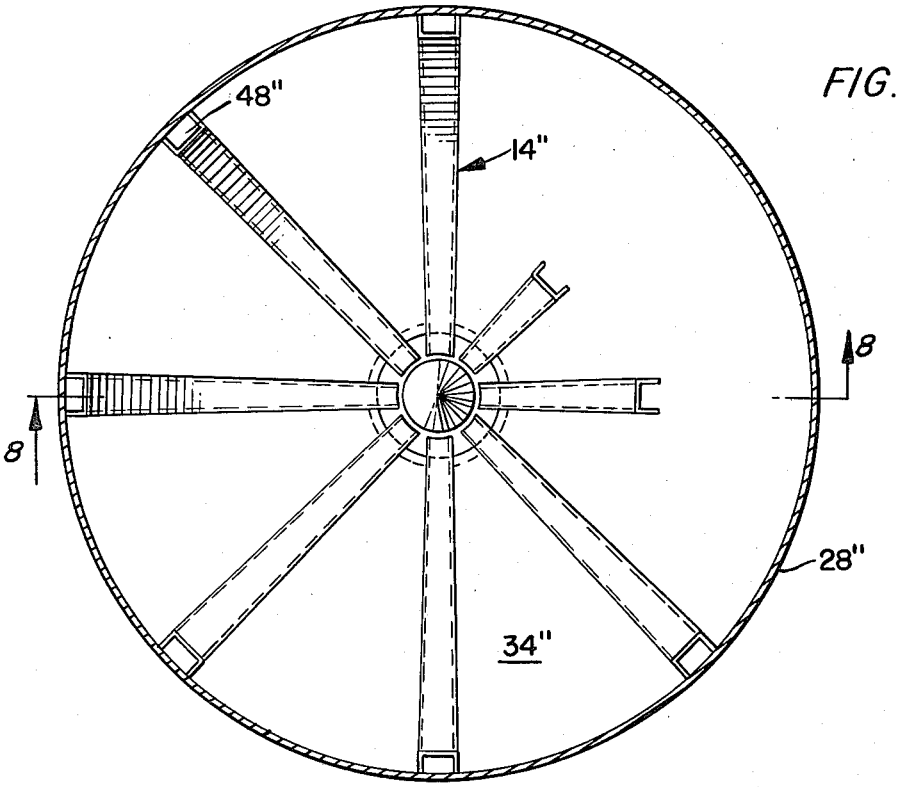
FIG. 7.
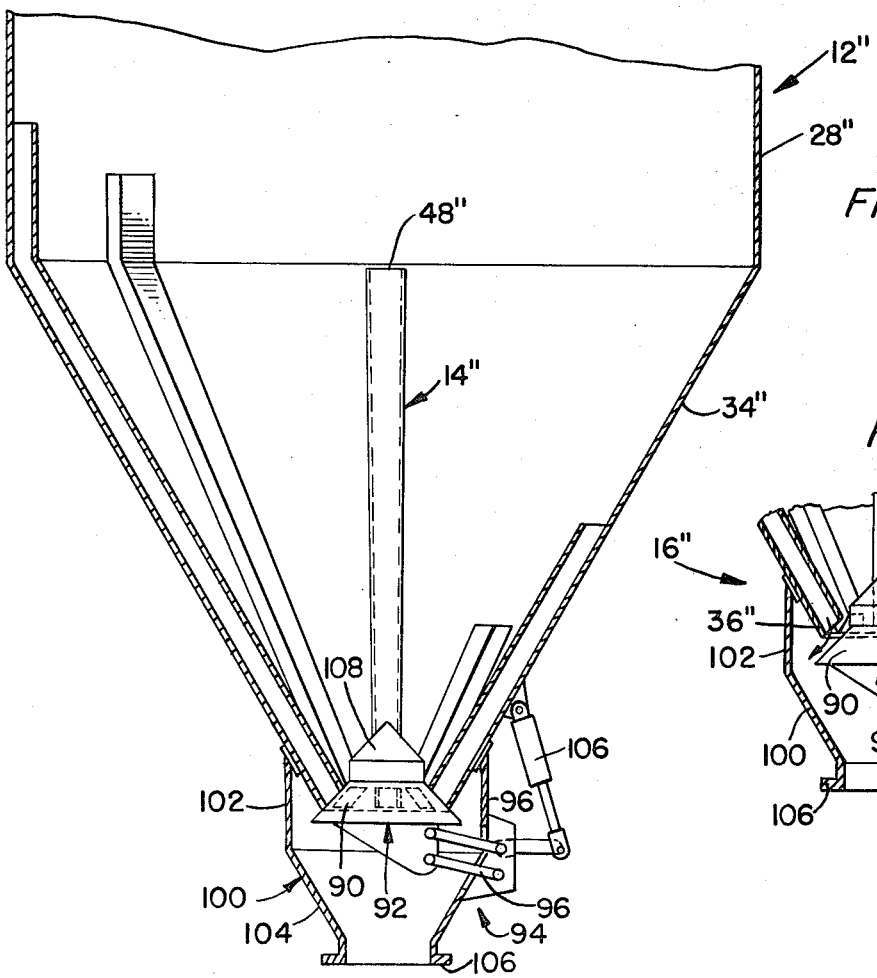
FIG. 8.
FIG. 9.
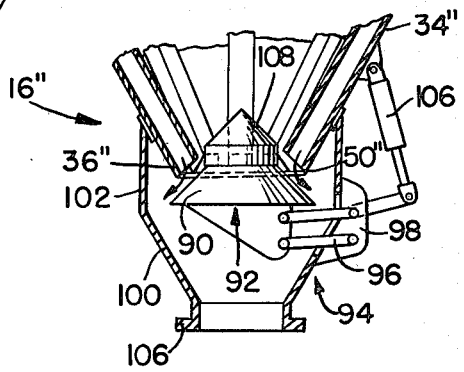

APPARATUS FOR GRAVITY BLENDING OR PARTICULATE SOLIDS

This invention relates to an apparatus for blending of particulate solids and more particularly to a gravity-flow type of blending wherein granular or particulate solids are withdrawn simultaneously from a multiplicity of levels with a heterogeneous mass of the solids at various locations about the mass and thereafter recombined with the recombined mass being subjected to a simultaneous withdrawal at a multiplicity of levels and thereafter being recombined.

A blending of particulate and granular solids is important to many manufacturing processes and especially to those in which the solids are produced in individual batches which frequently result in varying properties. Previously known blending apparatus has usually incorporated power driven devices such as agitators and pneumatic or mechanical conveyors to recycle the material being processed to the blender in order to achieve the desired homogeneity of the processed material. These power driven devices have usually been difficult and expensive to construct and maintain, while contributing to the overall complexity and susceptibility of the system to failures which stop production thereby decreasing profitability and requiring the expenditure of manpower and material to maintain a constant flow of the desired processed material through the manufacturing cycle. These prior known blending devices have required either mechanical agitators or recycling equipment to achieve the desired homogeneity for particular applications.

Therefore, it is the object of the present invention to provide a new and improved particulate solids blender.

A further object of the present invention is to provide a gravity flow particulate solids blender which is capable of providing a high degree of homogeneity to a mass of heterogeneous material in a single pass through a blender without requiring recirculation and without requiring any power driven elements in the blender.

Another object of the present invention is to provide an apparatus for blending a heterogeneous particulate mass in equipment having low initial installation costs and maintenance costs and which require no power driven elements.

An additional object of the present invention is to provide an improved apparatus for gravity flow solids blending which can be quickly and easily installed in existing facilities.

A better understanding of the manner in which the preferred embodiment of the invention achieves the objects of the invention will be enabled when the following written description is read in conjunction with the appended drawings in which:

FIG. 7 is a top elevational view of a second alternative embodiment of the present invention;

FIG. 8 is a fragmentary cross-sectional view taken along lines 8—8 in FIG. 7; and FIG. 9 is a fragmentary elevational view similar to FIG. 8 showing the plug valve in the open position.

Figure 1:
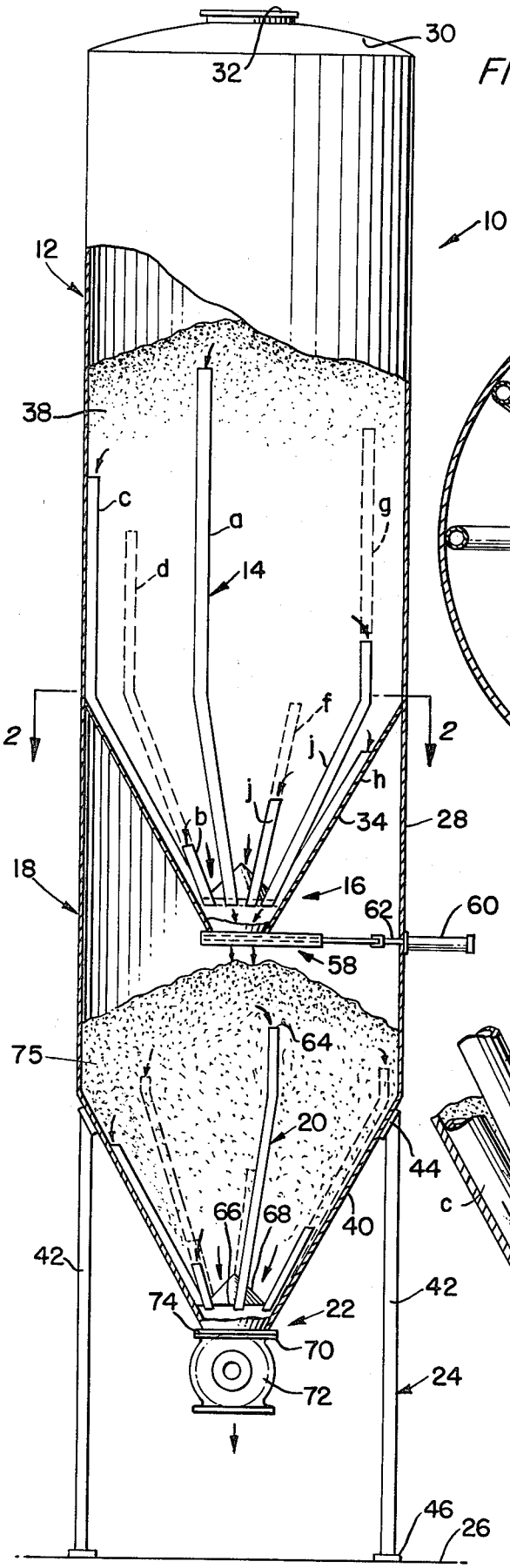
FIG. 1 is a fragmentary side elevational view of the preferred embodiment.
Figure 2:
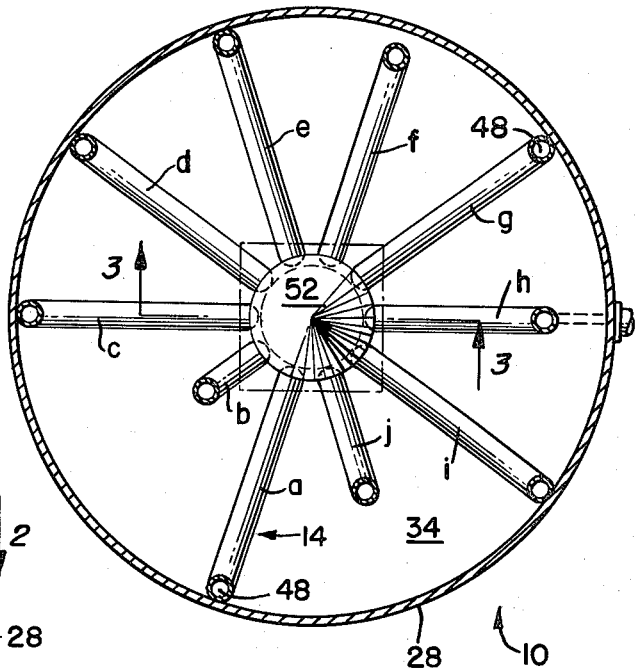
FIG. 2 is a cross-sectional view taken along lines 2—2 in FIG. 1.
Figure 3:
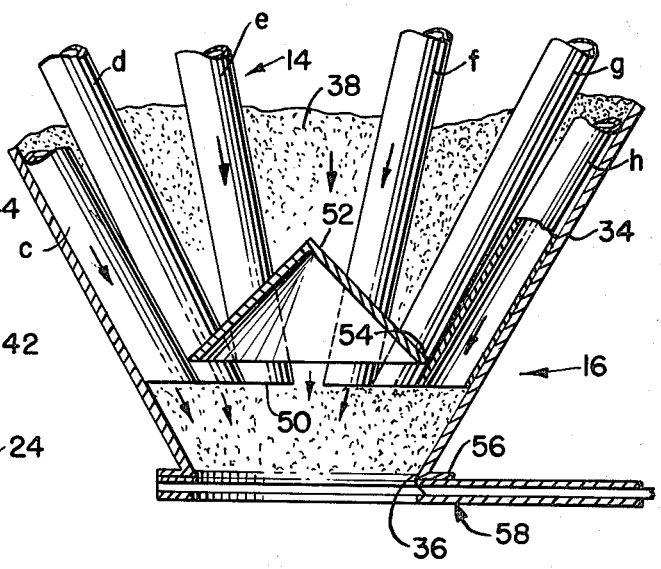
FIG. 3 is a fragmentary cross-sectional view taken along lines 3—3 in FIG. 2.

Attention is initially invited to FIGS. 1, 2 and 3 of the drawings illustrating the preferred embodiment, generally indicated by reference numeral 10, including an upper storage vessel 12 having withdrawal downcomers 14 and a discharge assembly 16, a lower storage vessel 18 having withdrawal downcomers 20 and a discharge assembly 22, and support legs 24 mounted on a floor 26.

The upper and lower storage vessels 12 and 18 may be formed within a cylindrical housing 28 formed of stainless steel, aluminum, steel or the like. The upper end of the housing 28 is closed by a cap 30 which is slightly dish-shaped and has its upper edges welded or attached in some manner to the upper edge of the cylindrical housing 28. At the center of the cap 30 is a material receiving port 32 having an opening through the center thereof which communicates with a pneumatic conveyor (not shown) to permit entry of a mass of heterogeneous material or materials into the upper storage vessel 12. The lower end of the upper storage vessel 12 is formed by an inwardly tapering conical wall 34 having its upper edge fixed to the inner surface of the housing 28 and being truncated at the lower end to provide a circular material exiting port 36, as shown in FIG. 3, through which material 38 may be discharged into the lower storage vessel 18.

Construction of the lower storage vessel 18 is similar to the upper storage vessel 12 having a conical lower wall 40 with its upper edge attached in some manner such as welding or brazing to the lower edge of the housing 28. The lower end of the conical wall 40 is truncated to form a downwardly opening cylindrical aperture similar to the lower end of the upper storage chamber 12.

The housing tube 28 is supported in a vertical position, as shown in FIG. 1, by support legs 24 formed of an elongated steel channel 42 having a pad 44 attached to the upper end thereof which is welded or bolted to the lower conical wall 40 and having a floor mounting plate 46 attached to the lower end thereof to contact the floor 26 and provide support for the blender.

A portion of the particulate matter 38 to be blended flows downwardly through the downcomers 14 which are designated as a through j for sake of clarity. The upper end of each downcomer 14 has an inlet port 48, as best shown in FIG. 2, with the inlet ports 48 opening at preselected vertically and circumferentially spaced apart locations to permit various areas of the heterogeneous mass 38 to be withdrawn simultaneously from the first storage vessel 12. The downcomers 14 are formed of cylindrical tubes which are attached to the housing 28 and conical wall 34 as shown in FIGS. 1 and 2. The lower ends of the downcomers 14 terminate in the same transverse horizontal plane, as best shown in FIG. 3, above the material exiting port 36.

The conical cylindrical walls 34 and 40 minimize solid flow holdup within the storage chambers as well as facilitating necessary cleaning operation.

Spaced slightly above the outlet ports 50 on the downcomers 14 is a conically shaped diverter 52 which is coaxial with the upper storage vessel forming an outwardly and downwardly inclined conical surface to divert the material 38 into openings between the downcomers 14 thereby causing the material 38 to flow past the outlet ports 50 at the lower end of the downcomer and blend therewith as the material flows through the downcomers and between the downcomers as indicated in FIG. 3. The outer edge 54 of the deflector 52 may be attached to the lower end of the downcomers by welding or the like as suggested in FIG. 3. Attached to the lower end of the upper conical wall 34 adjacent the material exiting port 36 is a flange 56 on which a conventional slide valve 58 is mounted to control the flow of material 38 from the upper storage vessel 12. An actuator 60 mounted on the housing wall 28 is operated by conventional means to extend a piston 62 and move the slide valve 58 to the desired position.

Withdrawal downcomers 20 and the lower storage 18 are similar in construction to downcomers 14 in the upper storage vessel having inlet ports 64 and outlet ports 66. A conical deflector 68 is shown in this illustration as being spaced above the material exiting port 70 formed at the lower end of the lower conical wall 40. It is to be noted, however, that desirable blending results have been achieved without deflector 68. Thus, while its presence may be desirable in certain instances, i.e., when blending certain materials, better blending results may be achieved without it. Although a slide valve similar to 58 at the lower end of the upper storage chamber could be used, a conventional rotary valve 72 is attached to a flange 74 mounted on the lower edge of the lower conical side wall 40 to control the rate of flow of material 75 from the lower storage vessel in a conventional pneumatic conveying tube at the lower end thereof which is not shown in FIG. 1.

Figure 4:
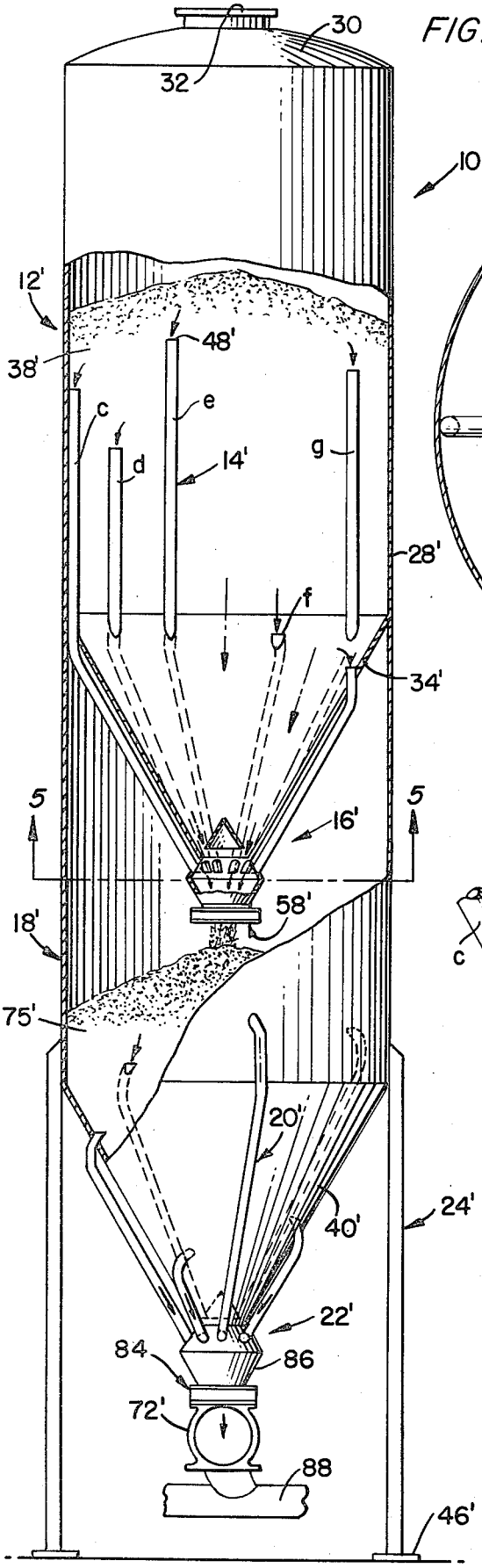
FIG. 4 is a fragmentary cross-sectional side elevational view of an alternative embodiment of the present invention.
Figure 5:
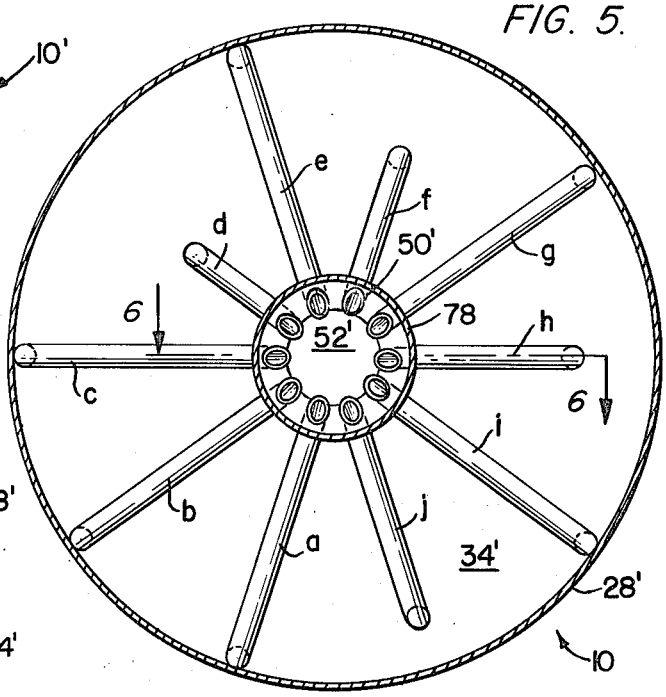
FIG. 5 is an enlarged cross-sectional view taken along lines 5—5 in FIG. 4.
Figure 6:
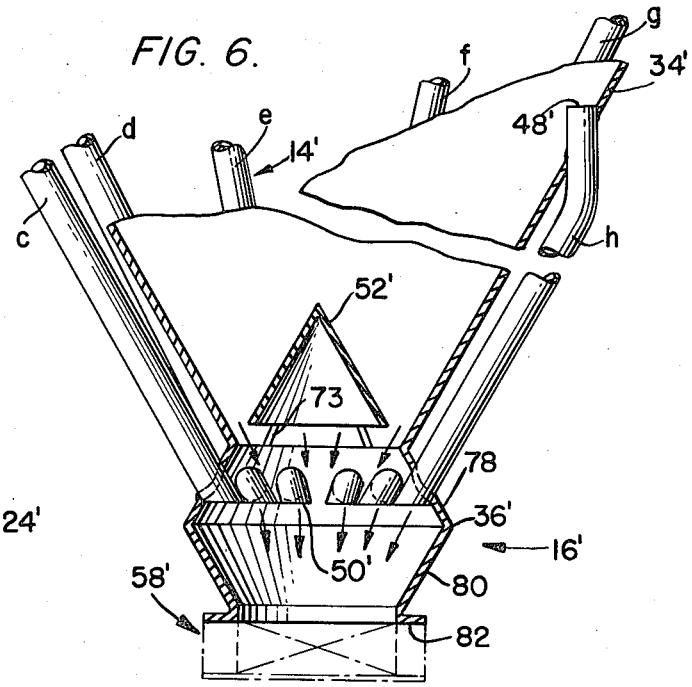
FIG. 6 is a fragmentary cross-sectional view taken along lines 6—6 in FIG. 5.

Referring now to the alternative embodiment disclosed in FIGS. 4, 5 and 6, components which are similar to the embodiment shown in FIGS. 1, 2 and 3 are identified by numerals with a prime sign. The major difference between the alternative embodiment shown in FIGS. 4, 5 and 6 and that shown in FIGS. 1, 2 and 3, is most clearly shown in FIG. 6 in which the downcomers 14' extend along an outer portion of the conical lower wall 34' and pass through the conical wall to position the inlet ports 48' within the upper storage vessel 12' at locations similar to the preferred embodiment shown in FIGS. 1, 2 and 3. Attached to the lower edge of the conical lower wall 34' is an outwardly inclined frusto-conical section 78 through which the lower ends of the downcomers 14' extend with their outlets ports angularly spaced apart and positioned in a single horizontal plane similar to the preferred embodiment shown in FIG. 3. Attached to the lower edge of the frusto-conical section 78 is an inwardly inclined frusto-conical section 80 having a flange 82 attached to the lower edge thereof to receive a conventional cutoff valve 58' to control flow of material 38' from the upper storage vessel into the lower storage vessel in a manner similar to that indicated in the preferred embodiment shown in FIG. 1. A conical deflector 52' is positioned above the material exiting port 36' by support brackets 73 which are fixed at the ends to the deflector 52' and the lower conical wall 34 respectively with the length being selected on the basis of flow characteristics of material to be processed through the blender. The lower storage vessel 18', as shown in FIG. 4, includes a lower material exit 22' similar to the material exiting assembly 16' as just described with the additional feature of a cutoff valve 84 mounted on a lower frusto-conical portion 86 and a rotary valve 72' mounted below the cutoff valve to control the rate of flow of material 75' in the lower storage vessel 18' into a pneumatic conveying passageway 88. Again, a diverter or deflector may be provided upstream of exit 22', although superior blending results may be achieved without it.

Referring now to the alternative embodiment shown in FIGS. 7, 8 and 9 in which components similar to the embodiments shown in FIGS. 1 and 4 and identified by reference numerals having a double prime sign, the downcomers 14'' are mounted on the inner surface of the lower conical wall 34' and the housing 28'. The downcomers are formed of U-shaped channels tapered toward the material exiting port 36'' with the outlet port 50'' of the downcomers 14'' being shaped to sealingly engage a conical surface 90 on a plug member 92 of a plug valve 94 as shown in FIG. 8 and 9. The plug member 92 is mounted on parallel links 96 which are pivotally attached at one end to the plug member 92 and at the opposite end to a mounting bracket 98 attached to a collection chamber wall 100 which is formed of a cylindrical upper portion 102 fixed to the lower conical wall 34'' and a frusto-conical inwardly inclined lower portion 104 opening into a flange 106 on which a slide valve similar to that shown in FIGS. 1 and 4 may be mounted. A conical deflector surface 108 is formed on an upper portion of the plug member 92, as shown in FIGS. 8 and 9, to provide a function similar to the performed by deflector 52 shown in FIGS. 3 and deflector 52' shown in FIG. 6 when the plug member has been moved to the open position as shown in FIG. 9.

Operation of the embodiment shown in FIGS. 1, 2 and 3 is easily accomplished by introducing the materials to be blended through inlet port 32 with th slide valve 58 in the closed position to accumulate the material in the upper storage vessel 12 as shown. Opening slide valve 58 permits the material to flow downwardly through the inlet port 48 on the downcomers 14 and between the downcomers in the area adjacent the deflector 52. The materials flowing through the downcomers are drawn in at various levels within the materials 38 thereby causing a combining of various portions of heterogeneous material with that flowing past the outlet ports 50 of the lower ends of the downcomers to cause blending of the materials as the materials flow through the material exiting port 36 and past the slide valve 58 into the lower storage vessel 18 for the initial blending. Materials 75 are drawn through the downcomers 20 and blended in a similar manner prior to being withdrawn in a highly homogeneous state through rotary valve 72 into the desired receiving apparatus such as a pneumatic conveying tube. The aforementioned high degree of homogeneity in blending is obtained in a single pass through the above-described apparatus or the following alternative embodiments without requirement for recirculation through the apparatus.

Operation of the alternative embodiment shown in FIGS. 4, 5 and 6, is accomplished in a similar manner wherein the materials 38' flow past the deflector 52' and are combined with various portions of the materials which flow through downcomers 14' and through outlets 50' to be blended together with the materials flowing through the material existing port 36' formed by the upper and lower frusto-conical portions 78 and 80. The flow of materials is controlled by the slide valves 58' in like manner. The material 75' in and the lower storage chamber 18' is blended in a similar manner by downcomers 20′ through a material existing section 22′ which is similar to material exiting section 16′ of the upper storage chamber with the possible exception of the absence of a deflector like 52′. Flow from the lower storage chamber is controlled by slide valve 84 and rotary valve 72′ to supply the desired materials to the pneumatic conveying tube 88.

Referring now to FIGS. 7, 8 and 9, the operation of this embodiment is similar to the two preceding embodiments with plug member 92 being moved by actuator 106 to open the upper storage vessel 12″ and permit material to flow through the downcomers 14″where it blends with material passing the conical deflecting surface 108 as the material in the downcomers flow from the outlet ports 50: and out through the collector 94 into the lower storage vessel. The lower storage vessel would have a material existing assembly of like construction with valves to control the flow therefrom in like manner.

From the foregoing detailed description, it will be evident that there are a number of changes, adaptations and modifications of the present invention which come within the province of those skilled in the art. However, it is intended that all such variations, not departing from the spirit of the invention, be considered as within the scope thereof as limited solely by the appended claims.

I claim as my invention:

1. A gravity flow particulate solids blender for blending a mass of heterogeneous material, comprising:

a first storage vessel having a first material receiving inlet and a first material exit port, a first plurality of particulate solids withdrawal downcomers communicating said first storage vessel with said first material exit port, said first downcomers being of differing lengths and having inlets and outlets spaced, respectively, around the periphery of said first storage vessel and the circumference of said first material exit port, a second storage vessel positioned downstream of said first storage vessel and having a second inlet communicating with said first material exit port and having a second material exit port, a second plurality of particulate solids withdrawal downcomers communicating said second storage vessel with said second material exit port, said second downcomers being of differing lengths and having inlets and outlets spaced, respectively, around the periphery of said second storage vessel and the circumference of said second material exit port and gating means for selectively allowing blended particulate solids to flow from said second material exit port for further processing.

2. The gravity flow particulate solids blender defined in claim 1 wherein said first and second storage vessels each comprise a cylindrical upper portion and a conical lower portion extending downwardly therefrom and terminating in one of said first and second material exit ports at the apex and said conical portion.

3. The gravity flow particulate solid blender defined in claim 2 wherein a number of said first and second downcomers are of lengths that place the inlets thereto at the conical portions of said first and second storage vessels.

4. The gravity flow particulate solids blender defined in claims 1 or 3 further comprising:

first diverter means for directing particulate solids from the portion of said first storage vessel immediately upstream of said first material exit port into said first material exit port between the outlets of said first downcomers.

5. The gravity flow particulate solids blender defined in claim 4 further comprising a second diverter means for directing particulate solids from the portion of said second storage vessel immediately upstream of said second material exit port into said second material exit port between the outlets of said second downcomers.

6. The gravity flow particulate solids blender defined in claim 4 further comprising a cut-off valve means for selectively closing said first material exit port.

7. The gravity flow particulate solids blender defined in claim 6 wherein said first and second material exit ports, respectively, include a downwardly opening aperture into which the outlets of, respectively, said first and second downwcomers empty and wherein said cut-off valve includes a plug means selectively insertable into said aperture to control the flow of material therefrom.

8. The gravity flow particulate solids blender defined in claim 7 wherein said downwardly extending apertures are circular and wherein said plug means includes a portion having a conical surface coaxial with the said circular aperture associated therewith, said conical surface of said plug being sized to seal with edges of said aperture when said conical portion is inserted into said aperture.

9. The gravity flow particulate solids blender defined in claims 1 or 3 wherein said outlets of said pluralities of said first and second downcomers are, respectively, in the same planes and further comprising:

first diverter means fo directing particulate solids from the portions of said first vessel immediately upstream of said first material exit port between the outlets of said first downcomers.

10. The gravity flow particulate solids blender defined in claim 9 further comprising a second diverter means for directing particulate solids from the portion of said second storage vessel immediately upstream of said second material exit port between the outlets of said second downcomers.

11. The gravity flow particulate solids blender defined in claim 1 wherein said pluralities of first and second downcomers are, respectively, entirely within said first and second vessels.

12. The gravity flow particulate solids blender defined in claim 1 wherein said pluralities of first and second downcomers are from the inlets thereof to substantially the central portions thereof within, respectively, said first and second vessel, said pluralities of first and second dowcomers then extend through the walls of, respectively, said first and second vessels to extend from the central portions to the outlet thereof on the exteriors of said first and second vessels.

* * * * *